US005503496A

United States Patent [19]

Voigt

[11] Patent Number: 5,503,496

[45] Date of Patent: Apr. 2, 1996

[54] RESILIENT SAFETY BARRIER

[75] Inventor: William L. Voigt, Bermuda Run, N.C.

[73] Assignee: Voigt Products Incorporated, Bermuda Run, N.C.

[21] Appl. No.: 444,065

[22] Filed: May 18, 1995

Related U.S. Application Data

[62] Division of Ser. No. 292,855, Aug. 19, 1994, Pat. No. 5,468,093.

[51] Int. Cl.[6] ..... E01F 9/017

[52] U.S. Cl. ..... 404/10; 256/13.1

[58] Field of Search ..... 256/13.1; 404/6, 404/9, 10, 11, 12, 13

[56] References Cited

U.S. PATENT DOCUMENTS

| | | | |
|---|---|---|---|
| 3,564,984 | 2/1971 | Alexander | 404/9 X |
| 3,712,589 | 1/1973 | Peterson et al. | 404/6 X |
| 3,858,997 | 1/1975 | Boone | 404/10 |
| 5,197,819 | 3/1993 | Hughes | 404/13 |

FOREIGN PATENT DOCUMENTS

| | | | |
|---|---|---|---|
| 1242844 | 8/1971 | United Kingdom | 404/10 |

*Primary Examiner*—David J. Bagnell
*Assistant Examiner*—James A. Lisehora
*Attorney, Agent, or Firm*—William G. Dosse; Moore & Van Allen

[57] ABSTRACT

A resilient mounting system for safety barriers, including guard rails, hand rails, etc., includes a urethane rubber or other resilient material substantially between the periphery of the barrier and a floor or base. The barrier is biased against the base so as to provide an initially stiff yet resilient impact resistance that yields to absorb the energy of impact, such as from a vehicle, rather than requiring the structural material of the barrier itself to absorb and perhaps become deformed by the impact. The resilient material can be shaped generally like the periphery of the barrier or it can be a standard shape that is replicated and arranged to engage a support for the barrier.

5 Claims, 3 Drawing Sheets

RESILIENT SAFETY BARRIER

This is a division of application Ser. No. 08/292,855 filed Aug. 19, 1994, now U.S. Pat. No. 5,468,093.

FIELD OF THE INVENTION

The present invention relates generally to safety barriers, railings, and supports incorporating mountings that will absorb substantial impact without permanent deformation. More specifically, the present invention relates to barriers, railings, and supports that will, on a continuing and reliable basis, without frequent repair or replacement, protect personnel from injury and plant and facilities from damage.

BACKGROUND OF THE INVENTION

Almost every dangerous curve on a highway has some sort of a crash barrier or guardrail intended to keep an out-of-control vehicle on the highway right-of-way. After a crash, such a barrier is often sufficiently damaged to require repair in order to restore its strength to try to save the next unlucky driver.

Most factories that have indoor vehicular traffic have crash barriers to confine the vehicles to designated paths and to keep them out of areas where they are not wanted. Unless such a barrier has been exceedingly overdesigned for the weight and expected speed of the vehicles used in the factory, in time the barriers will become bent, twisted, loose from the factory floor, and otherwise deformed so as to impair their appearance and probably even impair their effectiveness.

Hand railings and other edge supports are usually placed on stairwells and ramps for the support and safety of pedestrians using those facilities. If hand trucks and perhaps larger vehicles also use those facilities, the railings, etc., must either be seriously overdesigned for pedestrian purposes or will in time become bent and deformed from impacts by the much heavier, and less yielding wheeled vehicles.

Therefore, what is needed is a low-cost barrier, guardrail, or hand railing system which can receive and shrug off, without permanent deformation, the inevitable, occasional impacts from vehicles, without the need for massive overdesign of the barrier system, while maintaining a clean and neat appearance.

SUMMARY OF THE INVENTION

The present invention contemplates a resilient safety barrier that is resiliently supported on a base of some sort comprising a barrier member with the resilient support having a perimeter calculated to resiliently support the perimeter of the barrier member, and the barrier member being biased toward the resilient support and the base, so as to allow limited, non-destructive, shock-absorbent movement of the barrier member with respect to the base.

The present invention also contemplates a resilient mounting for a post structure on the surface of a base which includes a plurality of peripherally-arranged fastening facilities, with a plurality of peripherally-arranged fastening means also associated with the post, and a plurality of individual resilient bushings supporting the post, each such bushing associated with one of the plurality of peripherally-arranged fastening facilities associated with the base and, with one of the plurality of peripherally-arranged fastening means associated with the post, so as to allow limited, non-destructive, shock absorbent movement of the post with respect to the base.

The present invention further contemplates a resilient mounting for a barrier rail on at least two upright support members, with a rail member extending substantially between the two upright support members, a resilient gasket located between the rail member and each upright support member, so as to allow limited, non-destructive, shock-absorbent movement of the rail member relative to the upright support member, and with a clamp for squeezing the resilient gasket between the rail member and the upright support member.

BRIEF DESCRIPTION OF THE DRAWINGS

A more complete understanding of the present invention will be had from the following detailed description when considered in conjunction with the accompanying drawings, wherein the same reference numbers refer to the same or corresponding parts shown throughout the several views, in which.

DETAILED DESCRIPTION OF THE PREFERRED EMBODIMENT

Figure 1:
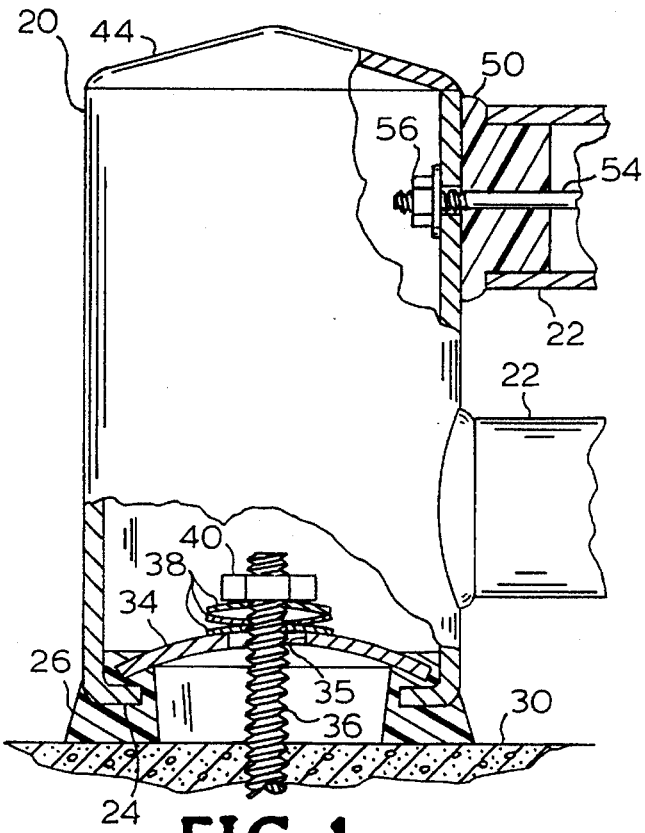
FIG. 1 is an elevation of an upright barrier member shown partially cut away in cross section to illustrate the mounting of rails to the barrier member and the resilient support on which the barrier member is mounted to a base.

Referring now to the drawings and particularly to FIG. 1, an upright, steel support member or barrier 20 of cylindrical shape is shown partially broken away in cross section. Two circular steel barrier rails or guardrails 22 are also shown, one shown in cross section. The guardrails 22 extend between the barrier 20 and another, similar barrier, not shown.

The bottom end of the upright support member or barrier 20 is preferably bent or otherwise formed inward to include a circular lip 24. A circular block 26 of an elastomer such as resilient urethane is preferably molded around the bottom end of the barrier 20 and the lip 24 with approximately the same circular shape as the barrier 20. The bottom of the urethane block is shaped flat so as to rest on a suitable base 30, usually of concrete or other paving or flooring material.

While urethane is preferred, any resilient material with advantageous mechanical properties and a strong resistance to taking a permanent set under stress can be used.

A domed steel plate 34 is preferably molded into the inside of the urethane block 26. A central hole 35 in the plate 34 accommodates a mounting bolt or stud 36 that is rigidly anchored into the base 30. The central hole 35 in the plate 34 is made slightly oversize for the stud 36, in order to allow manual adjustment of the barrier 20 and to accommodate manufacturing and installation tolerances.

While the domed plate 34 is shown molded into the inside of the urethane block 26, alternatively, a step could be formed in the inner, upper perimeter of the block 26; and the domed plate 34 could be nested into that step.

One or more (preferably three) spring washers 38 are placed around the stud 36 and on top of the plate 34. These spring washers 38 are generally dome-shaped and are compressed when, during installation of the barrier 20, a nut 40 is tightened onto the stud 36, in order resiliently to apply a substantial downward force on the plate 34 and thus hold the barrier in place. The pile-up of spring washers 38 is made by putting each spring washer in an alternating orientation as they are placed down about the stud 36.

Thus, the first spring washer 38 is placed in an orientation so that its periphery contacts the plate 34. This orientation of the first spring washer 38 has the advantage of having the periphery of the spring washer 38 extend beyond the oversize perimeter of the hole 35. The second spring washer 38 is then placed upside down with respect to the first spring washer and on top of the first spring washer, with the edge of its central aperture touching the edge of the central aperture of the first spring washer. Then the third spring washer 38 is oriented just like the first spring washer and is placed down on top of the second spring washer with the outer peripheries of the second and third spring washers in contact. In this way, the tightening of the nut 40 partially compresses the three spring washers 38 and forces or presses the plate 34 down and thus yieldably holds or biases the barrier 20 and the block 26 down to the floor or base 30.

If the base 30 is slightly uneven, such that the barrier 20 would stand tipped slightly to one side, the installer can move the barrier toward the lower side of the base 30, using some of the oversize diameter space allowed in the hole 35 through which the stud 36 extends. Then, when the nut 40 is tightened, the downward pressure is applied more strongly on the uppermost or higher side of the urethane block 26. That tends to compress the higher side of the urethane block 26 more than its lower side. That differential compression of the urethane block 26 tends to straighten the barrier 20, bringing it into a more vertical or plumb condition.

Figure 4:
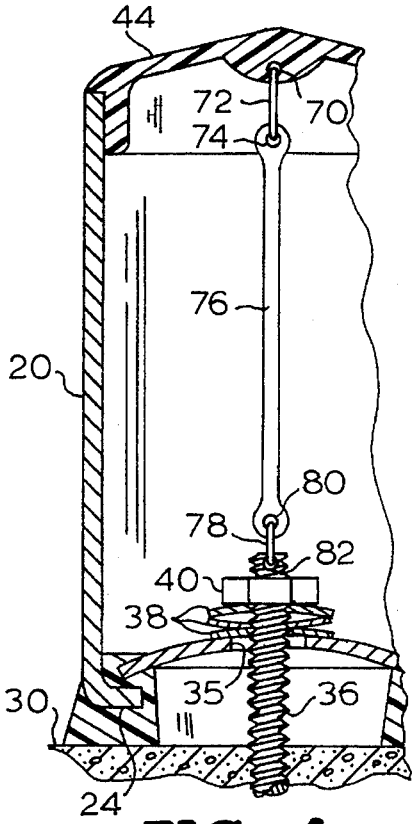
FIG. 4 is a partial view, in cross section, of the barrier member of FIG. 1 but showing a top resiliently held onto the barrier member.
Figure 5:
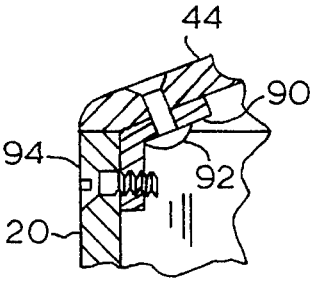
FIG. 5 is a detail, in cross section, of an alternative top held in an alternative manner to the barrier member.

The barrier 20 is preferably made from a length of common steel pipe of sufficient diameter and thickness to do the job. It is preferred that a standard, stock size of pipe be used and cut to the desired length. Therefore, preferably, the upright barrier 20 is open at the top in order to provide access to the inside of the barrier for on-site assembly and installation. However, the barrier 20 should preferably be capped for safety and cleanliness, as a final step in the on-site assembly process. Preferably, a cap 44 of pressed steel, molded thermoplastic rubber or any other crack-resistant, sturdy material can be mounted on the top of the upright support member or barrier 20 in order to protect anyone casually touching the barrier and to keep out dirt and moisture. Any removable mounting can be used for the cap 44. FIGS. 4 and 5 show two preferred mountings for a cap 44 and will be explained in greater detail hereinafter.

If the barrier 20 is struck by a vehicle, it will yield under the impact. The steel barrier cylinder 20 will not noticeably BEND under the impact so much as the barrier cylinder 20 will ROCK and squeeze the far side of the resilient, elastomeric urethane block 26, which will act as a high-hysteresis spring and absorb the energy of impact. The spring washers 38 will also yield slightly as the plate 34 rocks, so as to accommodate the selective squeezing of the block 26 that results from an impact. All of this is calculated to let the barrier resist the impact but yet yield under the impact without permanent deformation.

The barrier 20 can be either painted or covered by slipping a molded plastic cover over it, in order to reduce rust and defacing of its surface that would inevitably result from numerous impacts from vehicles.

The barrier 20 can stand alone to protect a corner or can be one of many vertical barriers used to protect a wall or line. Alternatively, the barrier 20 can be linked to another barrier, not shown, by a pair of guardrails 22 which provide a continuous barrier to traffic and thus protect a wall or line without necessitating an unreasonable number of individual vertical barriers.

The guardrails 22 can also be resiliently mounted to the barrier 20, as shown in FIG. 1. Preferably, the guardrails 22 are made of circular steel pipe of standard, off-the-shelf size and wall thickness. A stepped urethane gasket or plug 50 is slipped into each end (only one end shown) of the guardrail 22. Each plug 50 has a central hole which accommodates a rod or shaft 54, which extends into the interior of the barrier 20. The shaft 54 has threads at least at each end thereof for cooperating with a nut 56 which pulls on the two barriers 20 that support the ends of the guardrail 22 and compresses the gasket or plug 50 at each end of the guardrail 22.

The on-site installation of the barrier 20 and guardrails 22 (if fitted to the barrier 20) can preferably be done with the cap 44 off of the cylindrical barrier 20 and only mounted on the barrier 20 as nearly the final step in the on-site installation procedure. Therefore, all of the internal assembly, such as tightening the nuts 40 and 56, can be done through the open top of the barrier 20, before the cap 44 is installed.

Alternatively, but not preferred, the cap 44 can be either integrally formed with the cylindrical barrier 20 or can be welded to the cylindrical barrier 20 at the factory and preferably not welded on site but possibly welded on site. If the cap 44 is an integral part of the barrier 20, either by integral forming or by welding, as it is delivered to the installation site, access should be provided for tightening the installation nuts 40 and 56 on site. Therefore, an access opening (not shown) can be provided on the side of the barrier 20 opposite from the expected impacts, with machine screw or other fasteners for closing the door of the access opening.

When a guardrail 22 is struck by a vehicle, not only does the upright support member or barrier 20 yield under the impact, by reason of the block 26; but the gasket or plug 50 also yields slightly in order further to absorb the energy of impact.

ALTERNATIVES

Figure 2:
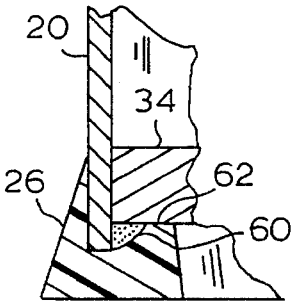
FIG. 2 is an alternative arrangement for mounting the barrier member to the resilient support.

Referring now to FIG. 2, if production volume is not adequate to justify tooling to form the lip 24 at the lower end of the barrier 20, the plate 34 can be welded, for example at a weld bead 60, onto the inside of the bottom or lower end of the barrier 20. The plate 34 can be a flat circle and need not be domed. Also, the weld bead 60 can be either on the top or on the bottom of the plate 34, although the bottom might be easier and thus cheaper. Without the need to mold the lip 24 and the plate 34 (FIG. 1) into the urethane block 26, the urethane block 26 can be cut and minimally shaped from flat, but thick, urethane stock. The base 26 can be cut with a shelf 62 to support the plate 34 and the barrier 20 and to accommodate the weld bead 60, if necessary. The bottom end of the barrier 20, together with the perimeter of the plate 34 and perhaps also With the weld bead 60, thus also constitutes a shelf which rests on the shelf 62 that is formed on the resilient mounting support or block 26.

Figure 3:
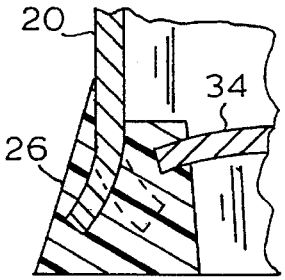
FIG. 3 is another alternative arrangement for mounting the barrier member to the resilient support.

Referring now to FIG. 3, if production volume is adequate to justify significant tooling, the lip 24 at the bottom of the barrier 20 can be formed into a plurality of lips 24 bent in alternate directions around the periphery of the bottom end of the barrier 20, much like the teeth of a saw are "set" to alternate sides of the blade.

Referring now to FIG. 4, the center and one side of the barrier 20 are shown in cross section with an example of a molded cap 44 of thermoplastic rubber. In order to removably hold the cap 44 in place on top of the barrier 20, a hole 70 is preferably formed in a web or boss on the inside of the cap 44. A hook or a cut or "jump" ring 72 (not shown in cross section, for clarity) is passed through the hole 70 and preferably through a hole 74 in the top end of a resilient rubber tarp strap or "bungee" strap 76. Another hook or jump ring 78 is passed through a hole 80 at the bottom end of the resilient strap 76 and through a hole 82 formed near the top end of the stud 36. Alternatively, a loop or an eye can be formed at the top end of the stud 36 or can be welded, screwed on, or otherwise formed on the top of the nut 40.

If a hook or a cut or jump ring 72 and 78 is cut or open at one point in its circumference, the entire load that it carries resolves to a bending stress that is at a peak on the side of the ring opposite from the cut. Therefore, the rings 72 and 78 should be designed accordingly. Such cut or jump rings are commonly used, albeit on a much smaller size scale, in the jewelry art. The hooks or jump rings 72 and 78 can be installed on site or can be factory installed with the last connection to the hole 82 being done on site. It will be evident to one skilled in the art that there are any number of alternate ways resiliently to hold the cap 44 to the barrier 20.

FIG. 5 shows, in fragmentary cross section, an alternate cap 44, in the form of a steel dome, and means for holding it in place.

A plurality of angle irons 90 are riveted around the inside edge of the cap 44 in the factory using rivets 92 having flat, recessed heads in countersunk holes on the exposed surface of the cap 44. The other arm of each angle iron 90 has a threaded hole. Flat-head machine screws 94 extend through countersunk holes around the top end of the barrier 20 to fasten the angle irons 90 and thus the cap 44 to the top end of the barrier 20.

Figure 6:
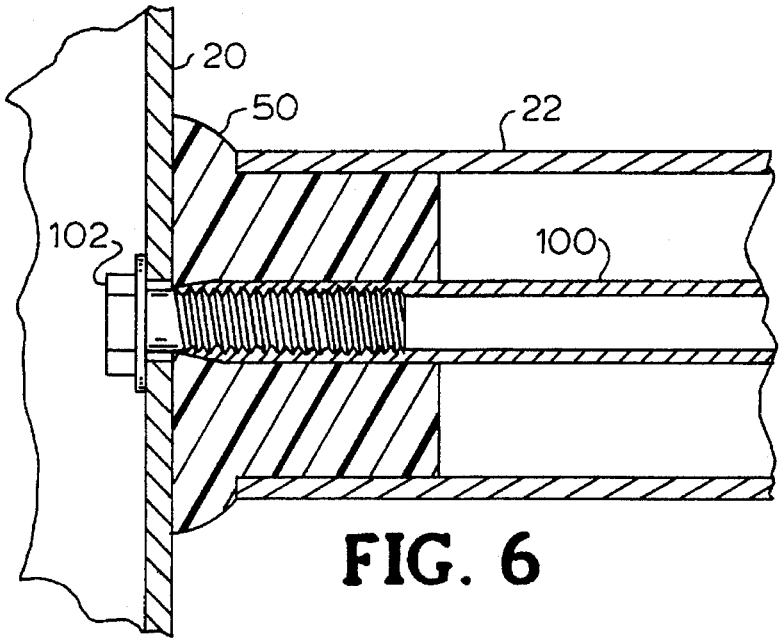
FIG. 6 is a partial cross sectional view showing one way to hold a rail to the barrier member.

FIG. 6 shows in cross section an alternate embodiment of the end treatment of the guardrail 22. Instead of the rod or shaft 54 (FIG. 1) with threaded ends and a nut 56 to tension the shaft 54, a larger central hole is formed in the gasket or plug 50 and a pipe or tube 100—the functional and structural equivalent of the rod or shaft 54—passes through the plug 50. With a tube 100 of larger diameter than the shaft 54, significantly higher friction can be achieved between the plug 50 and the tube 100 than is possible with the shaft 54. Therefore, it is more feasible to preassemble at the factory a plug 50 in each end of the guardrail 22 with the tube 100 firmly pressed into both plugs to hold them tightly in place. That subassembly can then be shipped to the assembly or job site with little fear that it will fall apart. The tube 100 is preferably on the order of a steel water pipe with either a galvanized or black oxided finish and internal threads formed at each end.

Consequently, at the assembly or job site, the guardrail 22 subassembly is placed into position between two barriers 20 and a bolt 102 is inserted through a hole in each barrier and threaded into each internally threaded end of the tube 100. In this way, the two barriers 20 don't have to be forced apart to allow the insertion of the ends of the shaft 54, which must be a bit longer than the distance between adjacent barriers.

Figure 7:
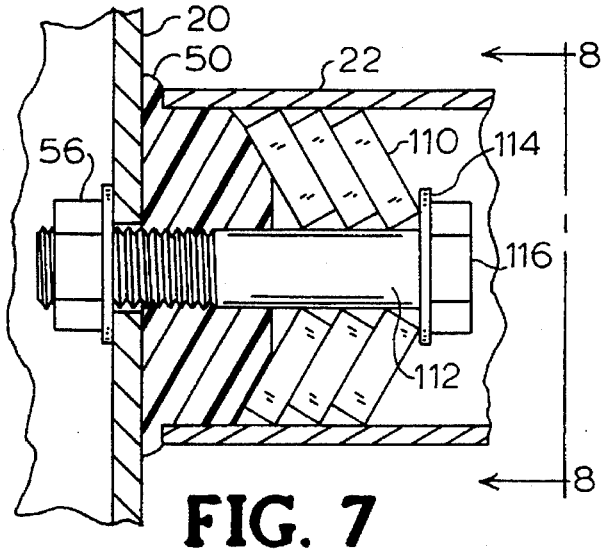
FIG. 7 is a partial cross sectional view showing another way to hold a rail to the barrier member.
Figure 8:
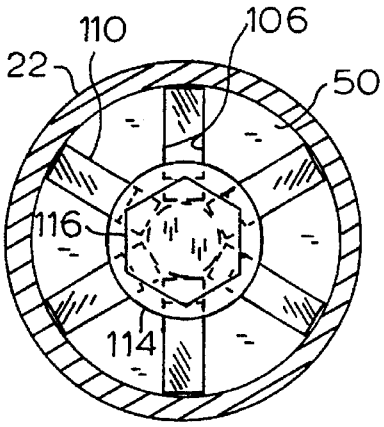
FIG. 8 is a cross sectional view taken along line 8—8 of FIG. 7.

FIGS. 7 and 8 show in cross section another alternative embodiment for holding the guardrail 22 to a barrier 20. The purpose of this embodiment is to obviate the long shaft 54 (FIG. 1) and the long tube 100 (FIG. 6). The whole idea is to grip the inside of each end of the guardrail 22. In this embodiment, the plug 58 is shaped with preferably six slots 106 (see FIG. 8) extending axially part way from the end of the plug 50 that is inside of the guardrail 22. At least one (but preferably three) hard steel slugs 110 are placed into each slot 106. The slugs 110 are long enough so that they will always be at an acute angle with respect to the axis of the guardrail 22. An inner edge of each slug bears against the unthreaded portion of a bolt 112 that extends out through the end of the guardrail 22 and the plug 50 and into the interior of the barrier 20. The slots 106 are just a bit smaller than the width of the slugs 110 so as to frictionally capture and hold the slugs in place.

At the assembly or job site, the slugs 110 are pressed into the slots in the plug 50, around the bolt 112, to form a subassembly. That subassembly is then pushed into the end of the guardrail 22, with the bolt 112 loosely in place or even pushed slightly into the plug 50 so as not to cause the slugs 110 to bind as they are eased into the end of the guardrail 22. When the plug 50 is as far into the end of the guardrail 22 as it should go, the bolt 112 is pulled tight to set the slugs, as shown in FIG. 7, into engagement with both the inside of the guardrail 22 and the unthreaded portion of the bolt 112. The bolt 112 can still be pushed in and out slightly to allow easy assembly of the guardrail 22 to the barrier 20.

When in place between two barriers 20, the threaded end of the bolt 112 is pulled into the interior of the barrier 20 and the nut 56 is threaded onto the bolt 112. The bite of the slugs 110 against the bolt 112 keeps it from rotating while the nut 56 is tightened, drawing a washer 114 on the head 116 of the bolt 112 against the slugs 110, wedging them into place, which causes the slugs 110 to bite into the interior surface of the guardrail 22 which prevents their axial movement out of the guardrail 22. If the bolt initially tends to rotate with the nut 56, a screwdriver slot can be formed at the threaded end of the bolt 112 to enable the assembler to keep the bolt 112 from rotating until the wedging action of the slugs 110 comes into play to apply great gripping force on the bolt 112.

The slugs 110 are preferably inexpensive, rectangular chunks of steel. While not fully shown in FIG. 7, the edges of the slugs 110 are not curved but are squared off, as more nearly illustrated in FIG. 8, where the slugs 110 meet the inside surface of the guardrail 22. Therefore, each slug 110 actually meets that inside surface of the guardrail 22 only at two points. Similarly, each slug 110 actually meets the unthreaded portion of the bolt 112 at only one point.

The inside diameter of the guardrail 22, the unthreaded portion of the bolt 112 and the slugs 110 are all sized such that the slugs 110 are all oriented much as shown in FIG. 7, whether tighten into place or just barely touching each other. Each slug 110 touches the inside of the guardrail 22 at one of its edges. That slug 110 also touches the unthreaded portion of the bolt 112 at the diagonally opposite edge of the slug 110 (see FIG. 7). Once installed in the guardrail 22, an imaginary diagonal line along the side of the slug 110 that extends between those two diagonally opposite edges should never be allowed to be perpendicular to the axis of the guardrail 22. That imaginary diagonal line should preferably be about ten degrees from the perpendicular.

While a pipe is an inexpensive and convenient structure for the guardrail 22, it will be evident that tubing of square or rectangular or any other suitable cross section can be equivalently used. Also, it will be evident that the ends of the guardrail 22 can be either squared off or can be curved on top and bottom to define a more uniform spacing between the ends of the guardrail 22 and the outside of the upright barrier 20.

While not specifically illustrated in FIGS. 6, 7, and 8, it will be evident to one skilled in the art that an equivalent of the clamping means shown in those three figures could strongly expand the portion of the urethane plug or gasket 50 within the inside of the guardrail 22 so as firmly to grip by friction the inside of the guardrail 22. For example, a frustoconical, 3-D wedge nut at the end of the plug 50 inside of the guardrail 22 could be internally threaded to cooperate with the threads of the bolt 102 so as to press inwardly at that inside end of the plug 50 as the bolt 102 is tightened, thereby tending strongly to expand that inside end of the plug 50 as well as biasing outwardly the entire length of the plug 50 within the guardrail 22. In may even be useful to either insert or mold into the plug 50 a second frustoconical wedge, with a clearance hole to accommodate the bolt 102. That second frustoconical wedge could be arranged in the reverse direction from the first wedge and located at or near the end of the plug 50 that is nearest to the upright barrier 20. The result would be even stronger expansion and pressing by the plug 50 on the inside surface of the guardrail 22.

The inside of the guardrail 22 can be coated with epoxy or other material to enhance the frictional grip of the elastomeric or urethane plug 50 on the inside of the guardrail 22. As an alternative, the resilient elastomeric plug 50 can even be bonded to the inside of the guardrail 22.

In order to enhance the resilience of the mounting of the guardrail 22 to the upright barrier 20, the clearance hole formed in the upright barrier 20 in order to accommodate the bolt 102 can be made larger than the minimum size necessary to accommodate the bolt 102. Then an elastomeric, eg., urethane, spacer can be placed in the bolt clearance hole, around the bolt 102 and between the head of the bolt 102 and the inside of the upright barrier 20.

It will be evident to one skilled in the applicable art that all of the embodiments disclosed for attaching the rail member or guardrail 22 to the upright support member or barrier 20 constitute some form of clamp for squeezing the resilient gasket or plug 50 between the guardrail 22 and the barrier 20.

While a resiliently-mounted upright barrier 20 has been disclosed herein with respect to a plurality of guardrails 22 between adjacent upright barriers, it will be recognized that one or more guardrails 20 could be installed in a free-standing condition, without any guardrails 22 between them. Also, any number of guardrails 22 can be used, besides the two shown.

LIGHTWEIGHT EMBODIMENT

Figure 9:
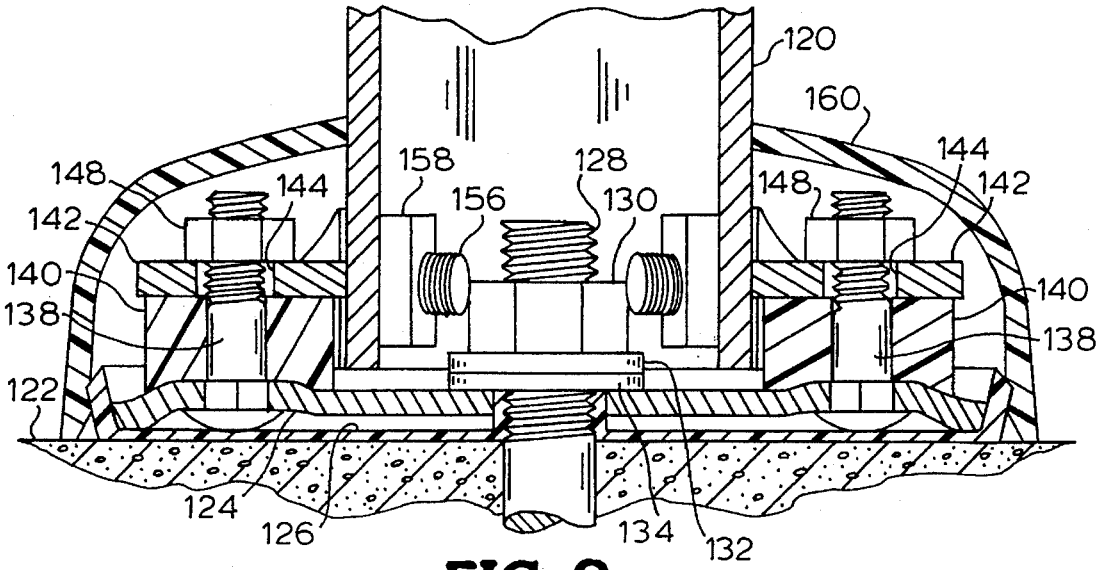
FIG. 9 is an elevational view in cross section of a lightweight, resilient post-mounting structure.

Referring now to FIG. 9, a lightweight resilient barrier support is shown for such uses as resiliently supporting hand railings along a pedestrian concourse or other passageway. A post 120 extends up from the area of the floor or base 122 which can be concrete or other material as in the case of the base 30 of FIG. 1. A base plate 124 rests on a resilient isolator pad 126, thereby locating the base plate 124 slightly above the base 122.

The base plate 124 and the isolator 126 have a central hole at least large enough to accommodate a stud 128 that is firmly anchored into the base 122. A nut 130 is threaded onto the stud 128 and is tightened to bear down on a steel washer 132 which in turn bears down on a resilient washer 134 (not shown in section) that presses the base plate 124 onto the isolator 126 and holds the base plate 124 firmly but with a slight resilience over the base 122.

The central hole in the base plate 124 is preferably somewhat larger than necessary to accommodate the stud 128. A portion of the resilient isolator 126 extends up through the central hole in the base plate 124, between the material of the base plate 124 and the stud 128 for resiliently locating the base plate 124 laterally with respect to the stud 128. The use-of the resilient isolator pad 126 and the resilient washer 134 allow a little bit of impact-absorbing movement of the base plate 124 and with it the post 120, but not enough movement for purposes of the present invention.

Four square holes placed at 90-degree positions about the base plate 124 accept and hold four carriage-type bolts 138 that extend upward from the base plate 124. A thick, resilient urethane block or bushing 140 (not shown in section), of preferably about 90–95 durometer stiffness, is placed around each of the four bolts 138 and on top of the base plate 124. A post support plate 142 (see FIGS. 10 and 11) rests on top of the four bushings 140, with the four bolts 138 extending through four holes 144 in four ears 146 on the support plate 140. A nut 148 is threaded onto each of the four bolts 138 and tightened down to squeeze the resilient bushings 140 between the support plate 142 and the base plate 124. It will be evident to one skilled in the art that a single, large resilient urethane block having the necessary four holes therein can be used in place of the four bushings 140.

Figure 10:
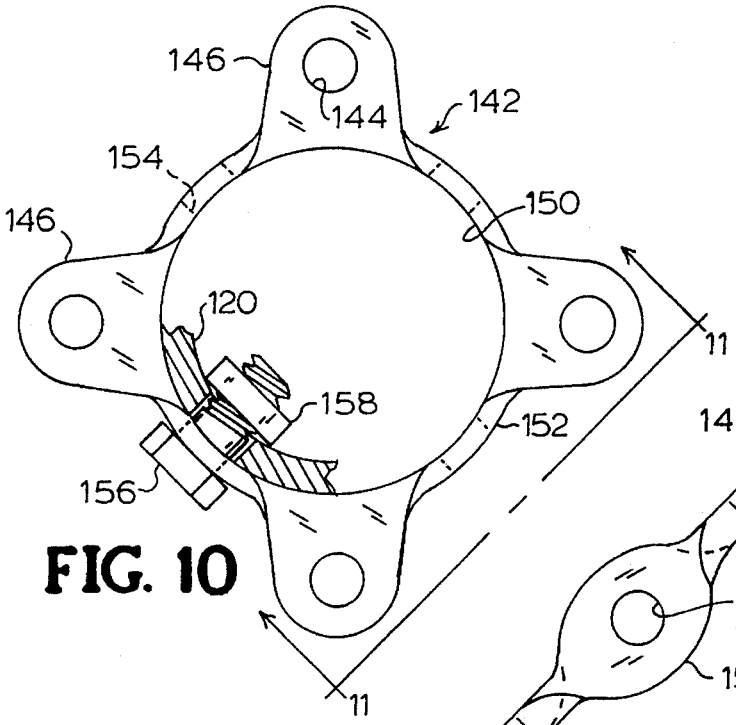
FIG. 10 is a detail view of a collar used for flexibly mounting a post, with a fragment of the post shown in cross section.
Figure 11:
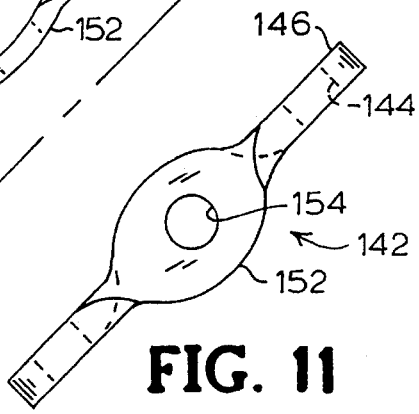
FIG. 11 is a view, taken along line 11—11 of FIG. 10.

The ears 146 on the support plate 142 are all in the same plane (see FIG. 11). The support plate 142 has a large central hole 150 large enough to accommodate the outside diameter of the post 120. There are four webs 152 between the four ears 146 (see FIGS. 10 and 11). The webs 152 are twisted so as to expose a slightly curved, interior surface that preferably engages the exterior of the post 120 (see FIG. 9). There is a hole 154 in each web 152. As shown in FIGS. 9 and 10, four bolts 156 extend through the holes 154 in the webs 152 and through matching holes in the post 120—a fragment of which is shown in cross section in FIG. 10—and are threaded into square nuts 158 on the inside of the post 120. The post 120, with the bolts 156 and the nuts 158, are preferably assembled to the support plate 142 before putting the support plate on the four bushings 140.

Preferably, the support plate 142 and the post 120 can be bolted together at the factory. However, if they are to be shipped separately to the installation site, preferably, there is a slight interference or press fit between the large central hole 150 and the outside diameter of the post 120. The interference fit should be loose enough to allow easy on-site assembly to bring the bottom of the support plate 142 even with the bottom of the post 120 by light tapping with a mallet or tapping of the post and plate on the base 122. However, the interference fit should be tight enough to hold the plate 142 tightly enough to the post 120 so that four holes can be drilled in the post 120 in direct alignment with the holes 154 in the webs 152, using the holes 154 as guides for free-hand drilling.

If the material of the support plate 142 is too thick for easy forming or for cost and scrap saving on low-volume production, the support plate 142 can be fabricated from four pieces of thinner strip that would then be spot welded together. For example, each strip would be the width of the ear 146. Each strip would be twisted (and holes punched) to form a single web 152 in the center with an ear 146 on each end. The two ears 146 would be 90 degrees apart, and the two ears would be offset by the thickness of the material. After electroplating for corrosion resistance, four such strips would be arranged in a spot welding jig. The web 152 of each strip would be 90 degrees away from its neighbor and the offset ears 146 from adjacent webs 152 would overlap. For example, the ear from the web to the right would be above and would overlap the ear from the web on the left, in each case. Then, the ears would be spot welded to the extent necessary in order to achieve the desired cantilever beam strength of each ear 146.

In order to get the post 120 to stand vertically or plumb, the nuts 148 are selectively tightened to bias the support plate 142 in two directions.

A dust cover 160 of urethane or some other type of rubber can be snapped over the entire structure shown in FIG. 9, extending from the post 120 to the base 122, using a groove molded into the lower, inner edge of the dust cover 160 to cooperate with a corner or ridge molded onto the periphery of the resilient isolator 126 to hold the dust cover 160 in place.

While this embodiment of the present invention is referred to as the "lightweight" embodiment, its size can be scaled up or down to almost any extent. Besides hand railings, the lightweight embodiment can be used to mount such diverse things as partitions and room dividers, turnstiles, wire fencing, time clocks and time card racks, signs of all kinds, parking meters, etc., etc.

While the form of apparatus herein described constitutes a preferred embodiment of this invention, it is to be understood that the invention is not limited to this precise form of apparatus, and that changes may be made therein without departing from the scope of the invention which is defined in the appended claims.

I claim:

1. A resilient mounting for a post structure on the surface of a base, comprising:

a base structure mounted on the base and having a plurality of peripherally-arranged fastening facilities rigidly attached to said base structure;

a support rigidly fastened to the post and having a plurality of peripherally-arranged fastening means positioned in proximity with but not in contact with the fastening facilities of the base structure; and resilient means for supporting the post, positioned between the plurality of fastening facilities on said base and the plurality of fastening means on the support and in intimate physical contact with both the fastening facilities and the fastening means, said intimate contact continuing as the post, its support and said fastening means moves relative to said base, said relative movement being accompanied by a commensurate resilient distortion of said resilient means, thereby allowing limited, non-destructive, shock-absorbent movement of the post with respect to the base.

2. A resilient safety barrier according to claim 11 wherein said base structure comprises:

a base plate on the base; and a resilient isolator pad between said base plate and said base.

3. A resilient safety barrier according to claim 1 wherein the resilient means for supporting the post comprises a plurality of individual resilient bushings, each bushing associated with one of the plurality of fastening facilities.

4. A resilient mounting for a post structure on the surface of a base, comprising:

base structure mounted on the base and comprising:

a base plate on the base, a resilient isolator pad between said base plate and said base, said base plate being biased toward the base by a single screw fastener passing through substantially the center of the base plate, and a plurality of peripherally-arranged fastening facilities rigidly attached to said base plate;

a support rigidly fastened to the post and having a plurality of peripherally-arranged fastening means positioned in proximity with but not in contact with the fastening facilities of the base structure; and resilient means for supporting the post, positioned between the plurality of fastening facilities on said base and the plurality of fastening means on the support and in intimate physical contact with both the fastening facilities and the fastening means, said intimate contact continuing as the post, its support and said fastening means moves relative to said base, said relative movement being accompanied by a commensurate resilient distortion of said resilient means, thereby allowing limited, non-destructive, shock-absorbent movement of the post with respect to the base.

5. A resilient mounting for a post structure on the surface of a base, comprising:

a base structure mounted on the base and having a plurality of peripherally-arranged fastening facilities rigidly attached to said base structure;

a support rigidly fastened to the post and having a plurality of peripherally-arranged fastening means positioned in proximity with but not in contact with the fastening facilities of the base structure;

resilient means for supporting the post, comprising a plurality of individual resilient bushings, each bushing associated with one of the plurality of fastening facilities, said resilient means positioned between the plurality of fastening facilities on said base and the plurality of fastening means on the support and in intimate physical contact with both the fastening facilities and the fastening means, said intimate contact continuing as the post, its support and said fastening means moves relative to said base, said relative movement being accompanied by a commensurate resilient distortion of said resilient means, thereby allowing limited, non-destructive, shock-absorbent movement of the post with respect to the base;

said fastening facilities on the base structure comprise a plurality of bolts, each bolt extending through its associated resilient bushing;

the resilient bushings being of a size to tend to hold the support away from the base structure;

the fastening means on the support resting on the resilient bushings and having openings to accommodate the bolts; and a plurality of nuts engaging the bolts and individually tightenable to selectively, partially compress the resilient bushings so as to facilitate plumbing of the post.

* * * * *